US009879366B2

(12) United States Patent
Toda et al.

(10) Patent No.: US 9,879,366 B2
(45) Date of Patent: Jan. 30, 2018

(54) STITCH LINE FORMING METHOD

(71) Applicant: TOYODA GOSEI CO., LTD., Kiyosu-shi, Aichi-ken (JP)

(72) Inventors: Minoru Toda, Kiyosu (JP); Chiharu Totani, Kiyosu (JP); Ryota Inagaki, Kiyosu (JP)

(73) Assignee: TOYODA GOSEI CO., LTD., Aichi-pref. (JP)

( * ) Notice: Subject to any disclaimer, the term of this patent is extended or adjusted under 35 U.S.C. 154(b) by 83 days.

(21) Appl. No.: 14/753,553

(22) Filed: Jun. 29, 2015

(65) Prior Publication Data

US 2016/0032507 A1 Feb. 4, 2016

(30) Foreign Application Priority Data

Aug. 4, 2014 (JP) ..... 2014-158739

(51) Int. Cl.

| | |
|---|---|
| ***D05B 15/04*** | (2006.01) |
| ***D05B 1/08*** | (2006.01) |
| ***D05B 1/00*** | (2006.01) |
| ***D05B 1/12*** | (2006.01) |
| ***D05B 93/00*** | (2006.01) |

(52) U.S. Cl.

CPC ..... *D05B 15/04* (2013.01); *D05B 1/00* (2013.01); *D05B 1/08* (2013.01); *D05B 1/12* (2013.01); *D05B 93/00* (2013.01)

(58) Field of Classification Search

CPC . B68G 7/00; B68G 7/04; D05B 47/00; D05B 63/00; D05B 1/12; D05B 15/04; D05B 93/00

USPC ..... 112/475.17, 475.01, 475.27, 254, 255, 112/221, 222

See application file for complete search history.

(56) References Cited

U.S. PATENT DOCUMENTS

| | | | | |
|---|---|---|---|---|
| 27,999 A * | 4/1860 | McCurdy | ..... | D05B 93/00 112/438 |
| 237,966 A * | 2/1881 | Elliott | ..... | D05B 61/00 112/475.17 |
| 378,644 A * | 2/1888 | Arnold | ..... | B32B 5/26 112/440 |
| 757,374 A * | 4/1904 | Webster | ..... | D05B 93/00 112/438 |

(Continued)

FOREIGN PATENT DOCUMENTS

JP 2013-43571 A 3/2013

*Primary Examiner* — Danny Worrell
*Assistant Examiner* — James Heracklis
(74) *Attorney, Agent, or Firm* — Posz Law Group, PLC

(57) ABSTRACT

While feeding an upholstery member, a sewing needle is reciprocated to form needle receiving holes, and an upper thread is passed through each needle receiving hole, caused to cross a lower thread, and pulled out of the needle receiving hole. The sewing cycle is repeatedly performed to form a stitch, so that stitches form a stitch line in a surface sheet. A direction of a force, which is generated by applying tension to the lower thread and which acts to rotate thread ends of a pair of adjacent stitches in each needle receiving hole about a crossing part of the upper thread and the lower thread, is defined as a rotation direction. The sewing needle is rotated in a direction opposite to the rotation direction to incline a diagonal line of the quadrangular shape forming the cross section relative to the feeding direction of the upholstery member.

13 Claims, 6 Drawing Sheets

(56) References Cited

U.S. PATENT DOCUMENTS 1,030,784 A * 6/1912 Chapelle ..... D05B 73/12 112/34
1,114,533 A * 10/1914 Myers et al. ..... D05B 93/00 112/437
1,219,024 A * 3/1917 Merritt ..... D05B 93/00 112/434
1,227,045 A * 5/1917 Fefell ..... D05B 93/00 112/438
1,252,150 A * 1/1918 Myers ..... D05B 61/00 112/437
1,269,125 A * 6/1918 Smith ..... D05B 3/14 112/408
1,284,911 A * 11/1918 Lautenschlager ..... D05B 3/14 112/475.09
1,308,294 A * 7/1919 Maloney ..... D05B 61/00 112/475.11
1,559,840 A * 11/1925 Baker ..... D05B 1/10 112/475.17
1,592,433 A * 7/1926 Belcher ..... D05B 3/02 112/248
1,643,406 A * 9/1927 Finch ..... D05B 3/20 112/405
1,699,423 A * 1/1929 Brase ..... D05B 93/00 112/438
1,943,300 A * 1/1934 De Voe ..... D05B 1/24 112/402
2,137,757 A * 11/1938 Gould ..... D05B 11/00 111/79
2,170,693 A * 8/1939 Ovington ..... D05B 93/00 112/422
2,487,988 A * 11/1949 Zeier ..... D05B 93/00 112/413
2,906,224 A * 9/1959 Henry ..... D05B 93/00 112/440
3,224,399 A * 12/1965 Lightner ..... D05B 93/00 112/410
3,291,085 A * 12/1966 Levy ..... A43B 13/28 112/475.09
3,447,498 A * 6/1969 Eguchi ..... D05B 1/06 112/168
3,463,102 A * 8/1969 Eklund ..... D05B 11/00 112/117
3,485,195 A * 12/1969 Torrence ..... D05C 15/20 112/226
3,812,799 A * 5/1974 Spanel ..... D05C 15/20 112/80.07
4,111,136 A * 9/1978 Spanel ..... D05C 15/18 112/261
4,117,792 A * 10/1978 Navlyt ..... D05B 1/20 112/433
4,120,255 A * 10/1978 McLain ..... D01D 5/253 112/222
4,140,069 A * 2/1979 Laursen ..... D05B 1/06 112/154
4,175,499 A * 11/1979 Navlyt ..... D05B 93/00 112/165
4,366,765 A * 1/1983 Hoekstra ..... D05B 93/00 112/429
4,580,514 A * 4/1986 Hanyu ..... D05B 1/20 112/162
4,590,878 A * 5/1986 Conti ..... D05B 1/06 112/154
5,333,562 A * 8/1994 LeMaire ..... D04H 3/002 112/440
5,359,950 A * 11/1994 Schellas ..... A41D 27/24 112/160
5,544,604 A * 8/1996 Winter ..... D05B 1/08 112/166
5,775,244 A * 7/1998 Nakayama ..... D05B 55/02 112/226
5,873,318 A * 2/1999 Bohlinger ..... D05B 23/00 112/302
5,881,663 A * 3/1999 Tsukioka ..... D05B 3/14 112/156
6,314,899 B1 * 11/2001 Ballantyne ..... D05B 1/12 112/475.17
6,401,640 B2 * 6/2002 Tanaka ..... D05B 1/10 112/200
6,962,120 B1 * 11/2005 Fujikura ..... D05B 1/12 112/475.17
7,690,318 B2 * 4/2010 Dooley ..... B29C 45/14 112/475.17
7,891,307 B2 * 2/2011 Sakuma ..... D05B 1/02 112/189
8,220,401 B2 * 7/2012 Hayashida ..... D05B 1/02 112/100
8,661,997 B2 * 3/2014 Sakuma ..... D05B 1/02 112/475.17
8,943,985 B2 * 2/2015 Hashimoto ..... D05B 1/10 112/165
9,297,100 B1 * 3/2016 Wu ..... D05B 1/18
2004/0154511 A1 * 8/2004 Takei ..... B60N 2/5883 112/475.17
2008/0022910 A1 * 1/2008 Schweizer ..... D05B 19/10 112/475.17
2008/0264320 A1 * 10/2008 Harward ..... A41D 27/24 112/475.17
2010/0212070 A1 * 8/2010 Asao ..... D05B 1/16 2/275
2010/0326341 A1 * 12/2010 Mingazhev ..... D05B 57/02 112/166
2011/0041745 A1 * 2/2011 Mingazhev ..... D05B 1/08 112/475.17
2011/0171435 A1 * 7/2011 Sheldon ..... B29C 45/14811 428/195.1
2011/0268375 A1 * 11/2011 Schinasi ..... D05B 13/00 383/107
2014/0076222 A1 * 3/2014 Hashimoto ..... D05B 1/10 112/475.17
2014/0182498 A1 * 7/2014 Torigoe ..... D05B 1/12 112/441
2014/0236280 A1 * 8/2014 Havel ..... D05B 21/00 623/1.13
2015/0176165 A1 * 6/2015 Wenzel ..... D05B 1/06 112/475.17
2015/0267330 A1 * 9/2015 Carrier ..... D05B 19/12 112/475.17
2015/0330005 A1 * 11/2015 Brunner ..... D05B 19/12 112/475.19
2015/0361605 A1 * 12/2015 Nakata ..... D05B 35/064 112/475.16
2016/0024700 A1 * 1/2016 Konno ..... D05B 93/00 112/423
2016/0032507 A1 * 2/2016 Toda ..... D05B 93/00 112/475.17
2016/0122927 A1 * 5/2016 Brown ..... D05B 93/00 112/475.08
2016/0122928 A1 * 5/2016 Wenzel ..... D05C 7/04 112/475.17

* cited by examiner

STITCH LINE FORMING METHOD

BACKGROUND OF THE INVENTION

The present invention relates to a method for forming a stitch line in an upholstery member.

For example, upholstered articles, of which at least the outermost parts are formed with surface sheets, are known to be used as interior parts such as instrument panels and consoles of vehicles. One form of such upholstered articles is as follows. An upholstered article includes a base member and an upholstery member provided on the base member. Upholstery members include ones that are formed by a single layer and ones that are formed by laminating a cushion layer on the back of a surface sheet. Upholstery members typically have stitch lines, in which stitches are arranged in two or more rows on the surface of the surface sheet.

When upholstered articles are manufactured, stitch lines are formed, for example, in the upholstery member. The upholstery member with the stitch lines is then bonded to the base member.

A sewing cycle is performed to form stitch lines in an upholstery member. The sewing cycle includes feeding an upholstery member 51 in a feeding direction A, which is perpendicular to the thickness direction of the upholstery member 51 (the direction perpendicular to the sheet of FIG. 11) and reciprocating a sewing needle in the thickness direction of the upholstery member 51. The sewing cycle forms needle receiving holes 52 in the upholstery member 51.

An upper thread 53, which is fed through reciprocation of the sewing needle, is passed through the needle receiving hole 52 from the front face of the upholstery member 51 and is then caused to cross a lower thread 54, which is located on the back face of the upholstery member 51. Thereafter, the upper thread 53 is pulled out of the needle receiving hole 52 from the front face. The sewing cycle is repeatedly performed to form a stitch 55 between adjacent needle receiving holes 52, so that stitches 55 are arranged in a row to form a stitch line 56. Thread ends 55*a* of an adjacent pair of the stitches 55 are arranged in each needle receiving hole 52.

As the sewing needle, one with a circular cross-sectional shape at the distal end is typically used. For example, Japanese Laid-Open Patent Publication No. 2013-43571 discloses a technique for forming a stitch line by sewing an upholstery member with an upper thread and a lower thread.

Recently, to improve the appearance of upholstered articles, there has been a trend in which stitches are demanded to extend in the feeding direction A of the upholstery member 51 to make a straight stitch line 56.

However, in the above described conventional stitch line forming method, tension is applied to the lower thread 54 as indicated by arrows X in FIG. 11 to ensure the sewing quality such as the appearance. Such tension generates a force F1 that acts to rotate the thread ends 55*a* in the needle receiving hole 52 about a crossing part 57 of the upper thread 53 and the lower thread 54, which serves as a pivot. The force F1 moves the thread ends 55*a* along a curved inner circumferential surface 58 of the needle receiving hole 52, so that the thread ends 55*a* rotate clockwise about the crossing part 57 as viewed in FIG. 11. Such rotation occurs in each needle receiving hole 52, so that each stitch 55 is inclined relative to the feeding direction A as shown in FIGS. 10 and 12. This configuration thus fails to satisfy the above demand.

SUMMARY OF THE INVENTION

Accordingly, it is an objective of the present invention to provide a stitch line forming method that is capable of forming a stitch line that approximates a straight line and has an improved appearance.

To achieve the foregoing objective and in accordance with one aspect of the present invention, a stitch line forming method is provided that includes: preparing an upholstery member in which at least an outermost part is formed of a surface sheet; performing a sewing cycle, in which, while the upholstery member is fed in a direction perpendicular to a thickness direction of the upholstery member, a sewing needle is reciprocated in the thickness direction of the upholstery member, to form needle receiving holes in the upholstery member; simultaneously with the sewing cycle, passing an upper thread, which is fed through the reciprocation of the sewing needle, through each needle receiving hole from a front face of the upholstery member, then, causing the upper thread to cross a lower thread, which is located on a back face of the upholstery member, and thereafter, pulling the upper thread out of the needle receiving hole from the front face; repeating the sewing cycle to form a stitch between each adjacent pair of the needle receiving holes; and simultaneously with the formation of the stitches, forming a stitch line in which the stitches are arranged in a row. The stitch line forming method further includes: preparing the sewing needle to have a quadrangular cross-sectional shape at a distal end; when a direction of a force, which is generated by applying tension to the lower thread and which acts to rotate thread ends of a pair of adjacent stitches in each needle receiving hole about a crossing part of the upper thread and the lower thread that serves as a pivot, is defined as a rotation direction, rotating the sewing needle in a direction opposite to the rotation direction to incline diagonal lines of the cross-sectional shape relative to the feeding direction of the upholstery member; and reciprocating the sewing needle with the diagonal lines of the cross sectional shape of the sewing needle inclined relative to the feeding direction of the upholster member.

In the above method, when forming a stitch line, an upholstery member is fed in a direction perpendicular to the thickness direction and the sewing cycle is performed to reciprocate the sewing needle in the thickness direction of the upholstery member. The sewing cycle forms needle receiving holes in the upholstery member. Each needle receiving hole has a quadrangular shape, which corresponds to the cross-section of the distal end of the sewing needle. The needle receiving hole has four flat inner wall surfaces. The diagonal lines of the quadrangular needle receiving hole are inclined relative to the feeding direction of the upholstery member. The upper thread, which is fed through reciprocation of the sewing needle, is passed through the needle receiving hole from the front face of the upholstery member and is then caused to cross the lower thread, which is located on the back face of the upholstery member. Thereafter, the upper thread is pulled out of the needle receiving hole from the front face. The sewing cycle is repeatedly performed to form stitches, each of which is located between adjacent needle receiving holes. Thread ends of an adjacent pair of the stitches are arranged in each needle receiving hole. Multiple stitches form a stitch line.

In the above described formation of the stitch line, when tension is applied to the lower thread to ensure the sewing quality such as the appearance, the tension generates a force that acts to rotate the thread ends of adjacent stitches in a needle receiving hole about the crossing part of the upper thread and the lower thread, which serves as a pivot. However, the flat inner wall surfaces of the needle receiving hole act to receive the thread ends of the stitches. Thus, unlike the case of a circular needle receiving hole, the thread ends are restricted from rotating about the crossing part. Nevertheless, the upholstery member, in which the needle receiving hole is formed, is soft. The flat state of the inner wall surfaces of the needle receiving hole therefore cannot be maintained due to the force, and there is a possibility of a slight rotation of the thread ends about the crossing part.

However, the diagonal lines of the quadrangular needle receiving hole are each inclined relative to the feeding direction of the upholstery member and in a direction opposite to the direction of the force that acts to rotate the thread ends of the stitches in the needle receiving hole (rotation direction). Thus, even if the thread ends of the stitches act to rotate about the crossing part, the thread ends are located on or close to a line that extends in the feeding direction of the upholstery member. Each stitch therefore extends along the line at a position on or close to the line. Accordingly, the stitch line, which is formed by multiple stitches, extends as a straight line extending in the feeding direction of the upholstery member.

In the above described stitch line forming method, the sewing needle is preferably reciprocated with one of the diagonal lines being inclined by an angle in a range from 10° to 20° relative to the feeding direction.

Reciprocation of the sewing needle while inclining the sewing needle in this range achieves the above described advantage of the stitch line approximating a straight line even if the set position of the sewing needle or machining varies to the maximum extent.

The above described stitch line forming method is capable of forming a stitch line that approximates a straight line and has an improved appearance.

DETAILED DESCRIPTION OF THE PREFERRED EMBODIMENTS

A method for manufacturing an upholstered article, which includes a stitch line forming method according to one embodiment, will now be described with reference to FIGS. 1 to 7.

First, an upholstered article 10 that is manufactured by the manufacturing method of the present embodiment will be described. The upholstered article 10 of the present embodiment may be any of various types of vehicle interior parts such as a vehicle instrument panel, a console, a door trim, a glove compartment, and a pillar garnish. For purposes of illustrating, the upholstered article will be exemplified by an article having a simple shape.

Figure 1:
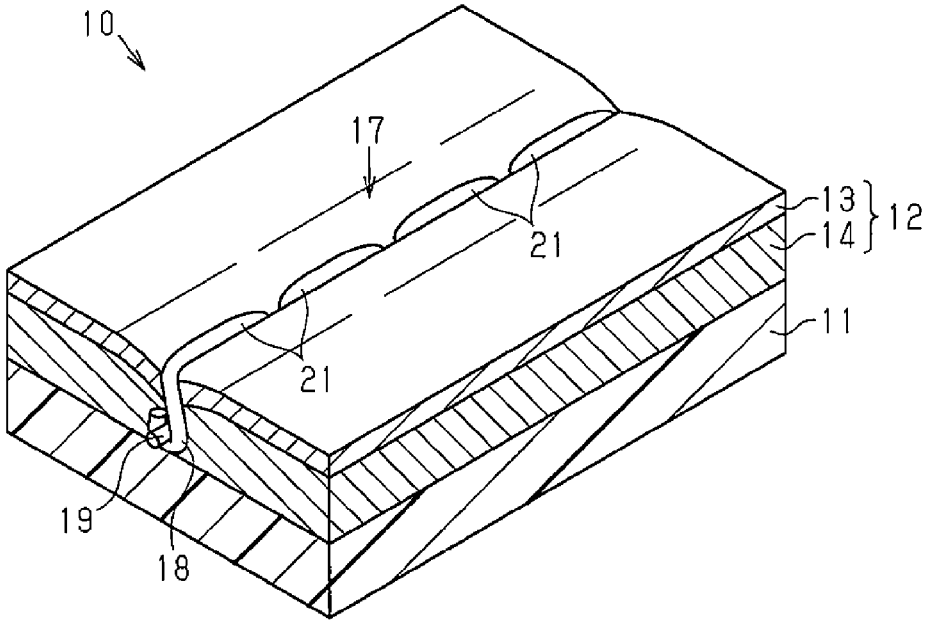
FIG. 1 is a partial perspective view showing an upholstered article, which has been manufactured by a stitch line forming method according to one embodiment.

As shown in FIG. 1, the upholstered article 10 includes a base member 11 and an upholstery member 12, which has a stitch line 17 and is arranged on the base member 11, as main components. Each of the components of the upholstered article 10 will now be described.

<Base Member 11>

The base member 11 forms the framework of the upholstered article 10 and has high rigidity. The base member 11 is formed into the shape of the article by injection molding a plastic such as polypropylene, polyethylene, and a polycarbonate/acrylonitrile butadiene styrene (PC/ABS) alloy. The base member 11 may include a non-planar surface (three-dimensional surface) such as a curved surface, an angular surface, and a surface with recesses and projections.

<Upholstery Member 12>

The upholstery member 12 is arranged along the surface of the base member 11 and is bonded to the base member 11 with adhesive while being held in close contact with the base member 11 on the back face of the upholstery member 12. At least the outermost part of the upholstery member 12 is formed by a surface sheet 13.

In the present embodiment, the upholstery member 12 includes the surface sheet 13, which forms the outermost part, and a cushion layer 14, which is laminated on the back face (the lower side as viewed in FIG. 1) of the surface sheet 13. The cushion layer 14 is bonded to the surface sheet 13 with adhesive.

The surface sheet 13 is employed mainly to improve the appearance and the tactile sensation of the upholstered article 10. The surface sheet 13 is a sheet with an even thickness made of artificial leather such as polyurethane, vinyl chloride, and thermoplastic elastomer (TPO).

The surface sheet 13 preferably has a thickness in the range from 0.35 mm to 1.5 mm. When having a thickness in the above range, the surface sheet 13 resists formation of wrinkles near the stitch line 17 during manufacture of the upholstered article 10. A thickness in the above range prevents the surface sheet 13 from being excessively hard and allows the upholstery member 12 to be easily deformed along and bonded to base member 11. The surface sheet 13 may be subjected to grain finish to have an appearance like a leather article.

The cushion layer 14 is mainly formed of a urethane slab and has elasticity. The cushion layer 14 is employed to improve the tactile sensation of the upholstered article 10. The cushion layer 14 preferably has a thickness in the range from 1.5 mm to 3.5 mm. When having a thickness in the above range, the cushion layer 14 ensures the appearance of the upholstered article 10.

The stitch line 17 is used as ornamentation (decoration) in the surface sheet 13, which forms the outermost part of the upholstery member 12, to ostensibly create the seam of parts of the surface sheet 13. This imparts to the upholstered article 10 an appearance as if genuine leather were used, thereby producing a quality appearance. The stitch line 17 of such a form is also referred to as ornamental stitches.

Figure 2:
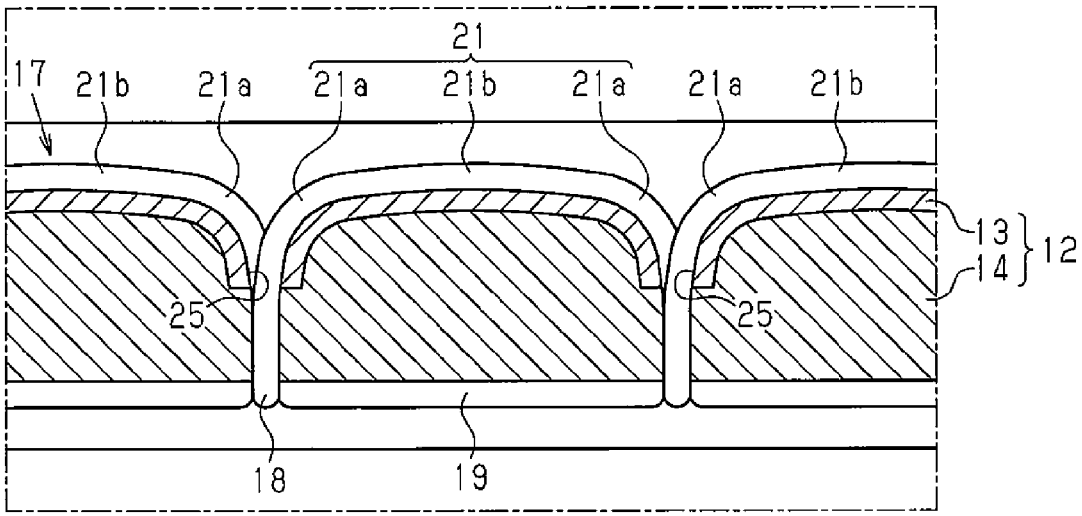
FIG. 2 is a longitudinal partial cross-sectional view showing an upholstery member in which the stitch line is formed.

The stitch line 17 is formed in the upholstery member 12 by repeating sewing cycle with an upper thread 18 and a lower thread 19. The stitch line 17 includes multiple stitches 21, which are arranged to form a row on the surface of the surface sheet 13. In other words, the upper thread 18 intermittently emerges on the surface of the surface sheet 13, and the emerging parts form the stitches 21. As shown in FIG. 2, opposite thread ends 21*a* of each stitch 21 are drawn into needle receiving holes 25 of the upholstery member 12 while being curved in a convex shape. Each stitch 21 has a substantially flat middle portion 21*b* that is located between the opposite thread ends 21*a*.

As operation of the present embodiment, a method for manufacturing the upholstered article 10 will now be described.

Figure 3A:
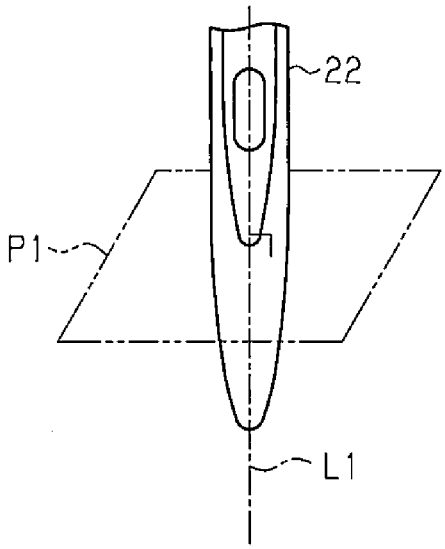
FIG. 3A is a partial front view showing the distal end of a sewing needle used in execution of the stitch line forming method.
Figure 3B:
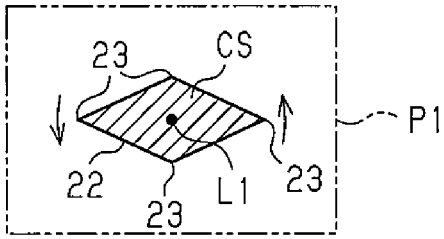
FIG. 3B is a cross-sectional view of the distal end of the sewing needle.
Figure 7A:
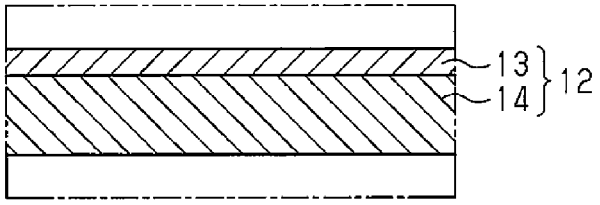
FIGS. 7A to 7D are process diagrams showing the process for manufacturing the upholstered article of FIG. 1.
Figure 7B:
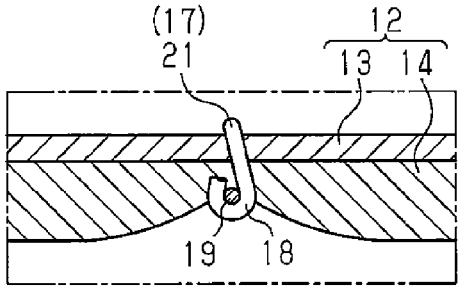

First, as shown in FIGS. 7A and 7B, the stitch line 17 is formed in the upholstery member 12. At the formation, sewing is performed by a sewing machine (not shown). The sewing machine uses a sewing needle 22, which is shown in FIGS. 3A and 3B. Assuming an imaginary plane P1 is perpendicular to the axis L1 of the distal end of the sewing needle 22, a cross section CS of the sewing needle 22 along the imaginary plane P1 has a quadrangular shape (a rhombus in the present embodiment). The sewing needle 22 is attached to the sewing machine such that one of the diagonal lines DL of the quadrangular shape forming the cross section CS is inclined by an angle $\alpha$ relative to a line L2 extending in a feeding direction of the upholstery member 12.

Figure 4:
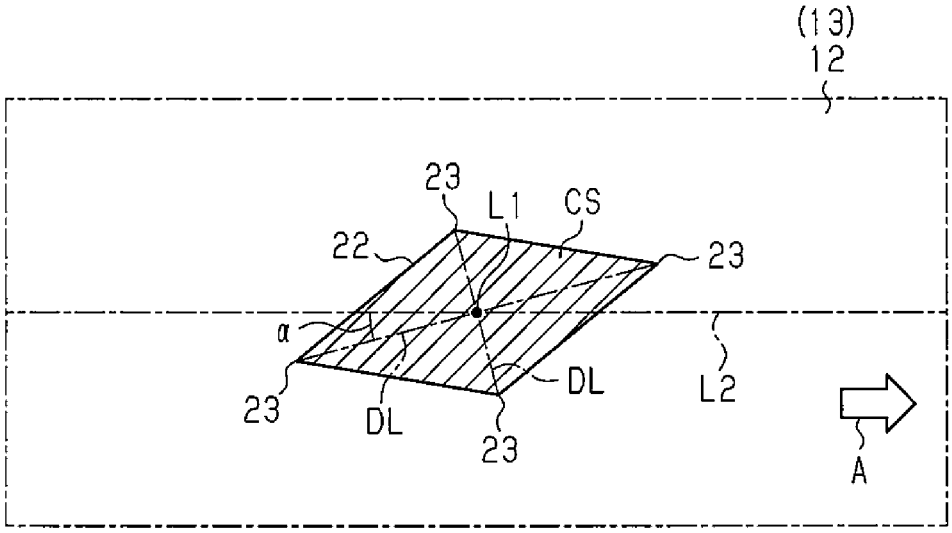
FIG. 4 is a horizontal partial cross-sectional view showing the relationship between the sewing needle and the feeding direction of the upholstery member.
Figure 6:
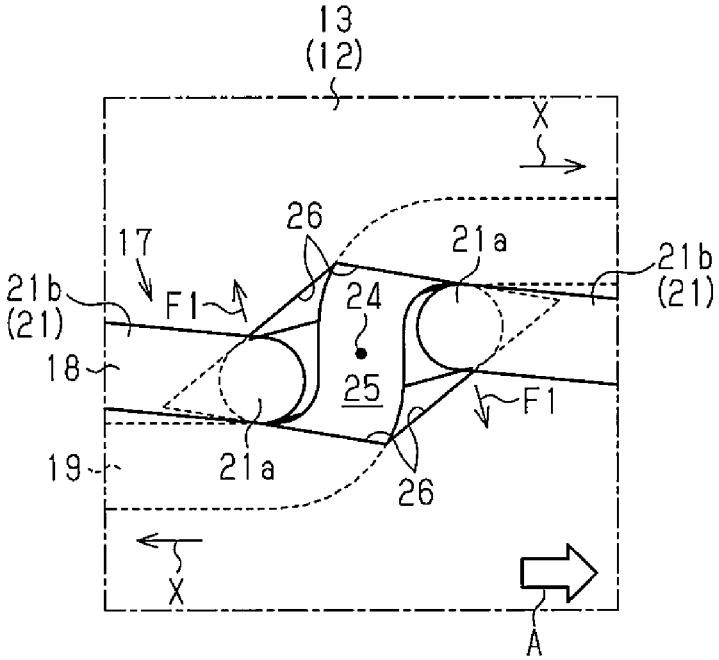
FIG. 6 is a partial plan view of the stitch line forming method, illustrating a needle receiving hole and the surrounding part in a state in which tension is applied to the lower thread.

As shown in FIG. 6, when tension is applied to the lower thread 19, a force F1 is generated that acts to rotate the thread ends 21*a* of adjacent pair of stitches 21 in the needle receiving hole 25 about a crossing part 24 of the upper thread 18 and the lower thread 19, which serves as the pivot. The direction of the force F1 is defined as a rotation direction. As shown in FIG. 4, the direction in which the sewing needle 22 is inclined, in other words, the direction in which one of the diagonal lines DL passing through a pair of corners 23 extends in the cross section CS, is inclined relative to the line L2 in a direction opposite to the rotation direction. Such inclination of the diagonal DL is achieved by rotating the sewing needle 22 counterclockwise about its axis L1 as viewed in FIGS. 3B and 4.

The angle $\alpha$ is preferably set in a range from 10° to 20°. Inclination of the diagonal line DL in this range relative to the feeding direction A (the line L2) allows the stitch line 17 to extend in a straight line in the feeding direction A of the upholstery member 12 even if the attachment of the sewing needle 22 varies or machining varies to the maximum extent in the permissible range.

At the formation of the stitch line 17, the sewing cycle is performed, in which the feeding mechanism of the sewing machine feeds the upholstery member 12 in the feeding direction A, which is perpendicular to the thickness direction of the upholstery member 12 as shown in FIG. 4, and the sewing needle 22 is reciprocated along the axis L1 of the sewing needle 22 and in the thickness direction of the upholstery member 12.

Execution of the sewing cycle forms the needle receiving hole 25 in the upholstery member 12 as shown in FIG. 6. The needle receiving hole 25 has a quadrangular shape (a rhombus in the present embodiment), which corresponds to the cross section CS of the distal end of the sewing needle 22. The needle receiving hole 25 has four flat inner wall surfaces 26. Further, the quadrangular needle receiving hole 25 has a diagonal line DL that is inclined by the angle $\alpha$ relative to the feeding direction A (line L2) of the upholstery member 12 (see FIG. 4). The direction of the inclination is opposite to the direction of the force F1 (rotation direction), that is, the inclination direction is counterclockwise as viewed in FIG. 6. The upper thread 18, which is fed through reciprocation of the sewing needle 22, is passed through the needle receiving hole 25 from the front face of the upholstery member 12 and is then caused to cross the lower thread 19, which is located on the back face of the upholstery member 12. Thereafter, the upper thread 18 is pulled out of the needle receiving hole 25 from the front face.

The sewing cycle is repeatedly performed to form a stitch 21 between adjacent needle receiving holes 25. Thread ends 21*a* of an adjacent pair of the stitches 21 are arranged in each needle receiving hole 25. The stitches 21 form the stitch line 17.

When forming the stitch line 17, tension is applied to the lower thread 19 as indicated by arrows X in FIG. 6 to ensure the sewing quality and appearance. The tension generates a force F1 that acts to rotate the thread ends 21*a* in the needle receiving hole 25 about the crossing part 24, which serves as a pivot. However, the flat inner wall surfaces 26 of the needle receiving hole 25 act to receive the thread ends 21*a*. Thus, unlike the conventional configuration, in which the needle receiving hole 52 is circular, the thread ends 21*a* are restricted from rotating clockwise, or in a direction along the force F1 about the crossing part 24. Nevertheless, the upholstery member 12 (the surface sheet 13, the cushion layer 14), in which the needle receiving holes 25 are formed, is soft. The flat state of the inner wall surfaces 26 of the needle receiving hole 25 cannot be maintained due to the force F1, which acts to rotate the thread ends 21*a*, and there is a possibility of a slight rotation of the thread ends 21*a* about the crossing part 24.

Figure 5:
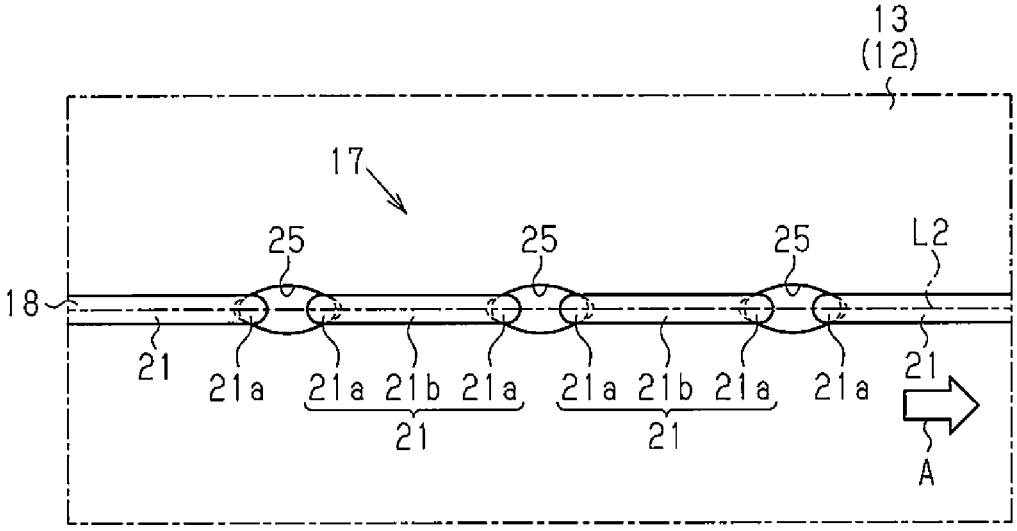
FIG. 5 is a partial plan view showing the stitch line formed by the stitch line forming method.

However, the diagonal line DL of the quadrangular needle receiving hole 25 is inclined relative to the feeding direction A of the upholstery member 12 and in a direction opposite to the direction of the force F1 (rotation direction), that is, in the counterclockwise direction as viewed in FIG. 6. Thus, even if the thread ends 21*a* act to rotate about the crossing part 24, the thread ends 21*a* are located on or close to the line L2, which extends in the feeding direction A as shown in FIG. 5. Each stitch 21 extends along the line L2 and is located on or close to the line L2. Accordingly, the stitch line 17, which is formed by the multiple stitches 21, extends in the feeding direction A.

The upholstery member 12 of FIG. 7B, in which the stitch line 17 has been formed, is used for manufacturing the upholstered article 10 shown in FIG. 1. In the manufacture, the base member 11, which has been formed separately from the upholstery member 12, is used.

Figure 7C:
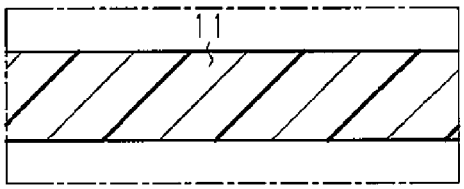

As shown in FIGS. 7B and 7C, adhesive is applied to the front face of the base member 11 or the back face of the upholstery member 12 (the cushion layer 14). Substantially the entire back face of the cushion layer 14 is brought into close contact with and bonded to the front face of the base member 11.

Figure 7D:
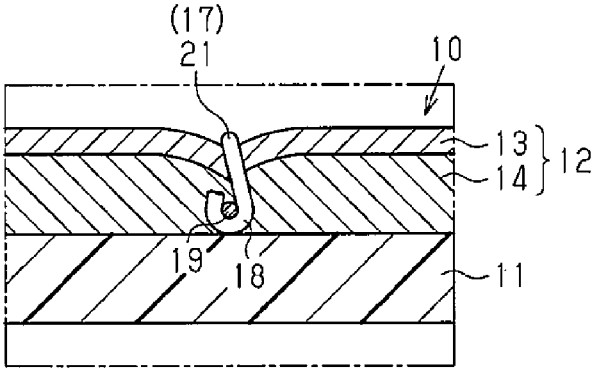

In the present embodiment, at the bonding, the base member 11 and the upholstery member 12, which are overlaid on each other, are pressed against each other by a pressing machine (not shown) from the opposite sides. Accordingly, as shown in FIG. 7D, the cushion layer 14 of the upholstery member 12 is bonded to the front face of the base member 11 to obtain the upholstered article 10, which is the objective of the manufacture.

The present embodiment as described above achieves the following advantages.

(1) As the sewing needle 22, a needle that has a quadrangular (rhombus) cross section CS at the distal end is employed (FIGS. 3A and 3B). The direction of the force F1 (FIG. 6), which is generated by applying tension to the lower thread 19 and acts to rotate the thread ends 21*a* in the needle receiving hole 25 is defined as a rotation direction. The sewing needle 22 is rotated in a direction opposite to the rotation direction, so that the diagonal line DL of the quadrangular shape forming the cross section CS is inclined relative to the feeding direction A of the upholstery member 12 (FIG. 4). The sewing needle 22 is reciprocated in this state.

Therefore, even if the force F1 acts to rotate the thread ends 21*a* (FIG. 6), the thread ends 21*a* are maintained on or close to the line L2, which extends in the feeding direction of the upholstery member 12 (FIG. 5). Each stitch 21 extends along the line L2 and is located on or close to the line L2, so that the stitch line 17 extends as a straight line extending in the feeding direction A. As a result, the stitch line 17 is formed to approximate a straight line and have an improved appearance.

(2) The sewing needle 22 is reciprocated with one of the diagonal lines DL being inclined by 10° to 20° relative to the feeding direction A (the line L2) as shown in FIG. 4.

Therefore, even if the attachment of the sewing needle 22 varies or machining varies to the maximum extent in the permissible range, the above advantage (1) is achieved, that is, the stitch line 17 is formed to approximate a straight line and have an improved appearance.

The above embodiment may be modified as follows.

Instead of artificial leather, genuine leather may be used for the surface sheet 13 of the upholstery member 12.

Instead of a urethane slab, foam material such as ethylene foam or propylene foam may be used for the cushion layer 14. These foam materials are characterized by being soft with continuous cells and restorability. Also, woven fabric may be used for the cushion layer 14.

Instead of adhesive, the cushion layer 14 may be bonded to the surface sheet 13 with double-sided tape or tackifier. The surface sheet 13 and the cushion layer 14 may be bonded to each other by flame treatment.

Likewise, instead of adhesive, the upholstery member 12 may be bonded to the base member 11 with double-sided tape or tackifier. The upholstery member 12 and the base member 11 may be formed without adhesive.

As long as the cross section CS of the distal end of the sewing needle 22 has a quadrangular shape, the cross section CS may have any shape different from a rhombus.

In the illustrated embodiment, the stitch line 17 is used as ornamentation in the surface sheet 13 to ostensibly create the seam of parts of the surface sheet 13. However, the stitch line 17 may be used to join two or more upholstery members 12.

Figure 8:
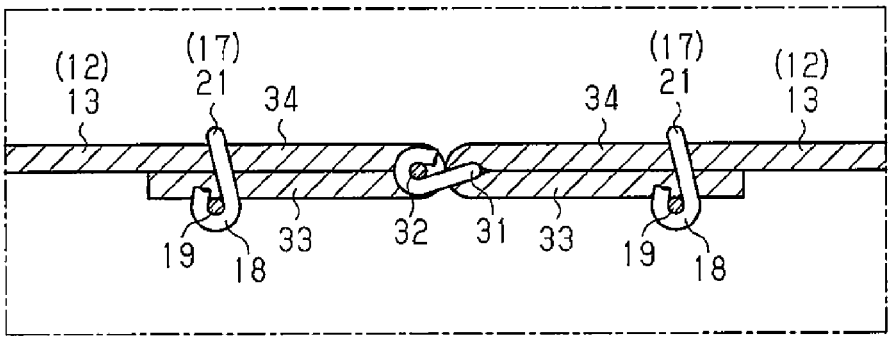
FIG. 8 is a longitudinal partial cross-sectional view showing an upholstery member according to a modification in which a stitch line is formed.
Figure 9:
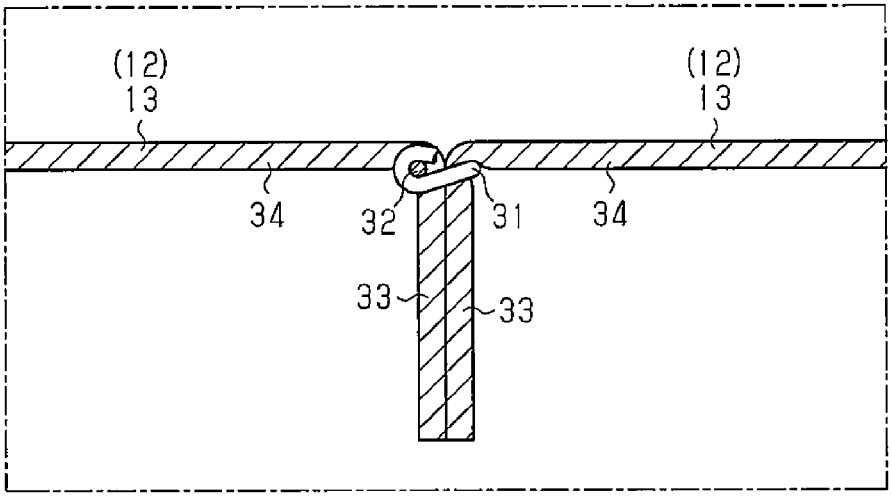
FIG. 9 is a longitudinal partial cross-sectional view of a halfway stage of formation of the stitch line of FIG. 8 in the upholstery member, illustrating a state in which two adjacent surface sheets are sewn together.
Figure 10:
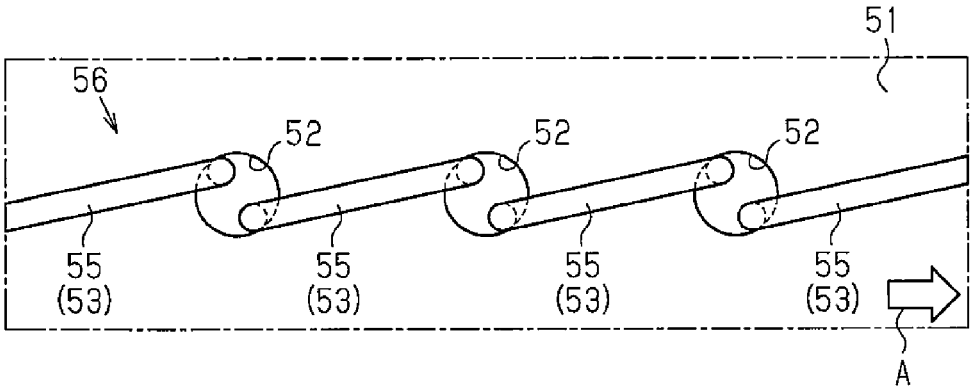
FIG. 10 is a partial plan view showing a stitch line formed by a conventional stitch line forming method.
Figure 11:
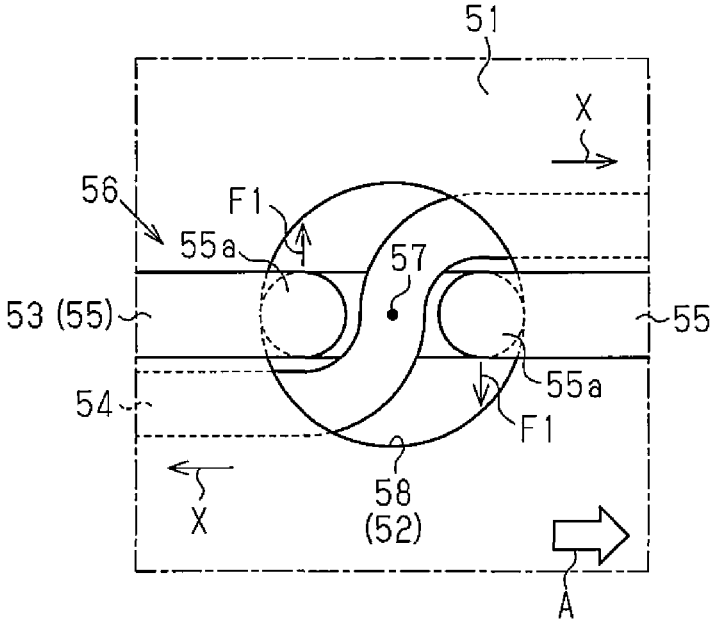
FIG. 11 is a partial plan view of the conventional stitch line forming method, illustrating a needle receiving hole and the surrounding part in a state in which tension is applied to the lower thread.
Figure 12:
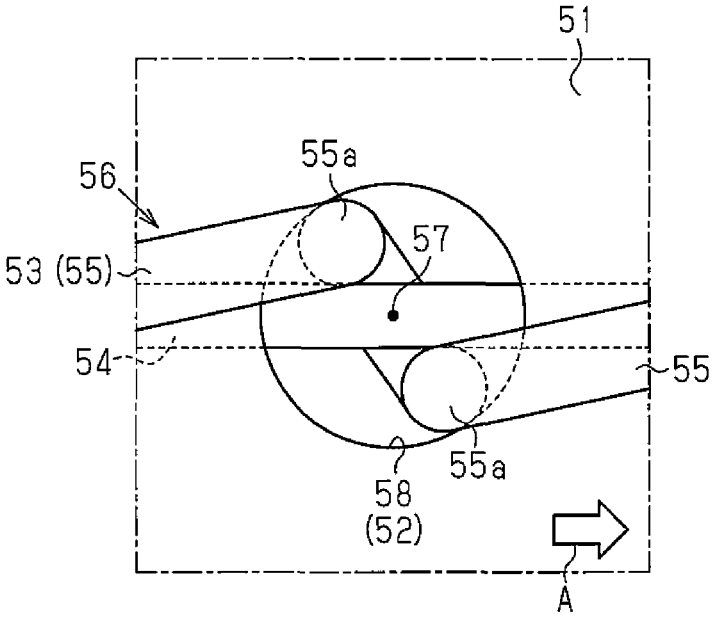
FIG. 12 is a partial plan view of the conventional stitch line forming method, illustrating the needle receiving hole and the surrounding part after tension is applied to the lower thread.

In the illustrated embodiment, the upholstery member 12 is formed by laminating the cushion layer 14 onto the back face of the surface sheet 13. However, the upholstery member 12 may be formed only of a surface sheet 13, which is a single layer material. FIGS. 8 and 9 illustrate one modification in which two upholstery members 12 are used. In this example, each upholstery member 12 is formed only of a single surface sheet 13, and a stitch line 17 is formed in each upholstery member 12.

In this modification, at least end portions of the adjacent of surface sheets 13 are overlaid onto each other as shown in FIG. 9, and the parts that are spaced from the edges by a certain distance are sewn together with an upper thread 31 and a lower thread 32, so that the surface sheets 13 are joined to each other. The sewing creates multiple stitches, and each stitch may be parallel with the feeding direction A as in the above illustrated embodiment or inclined relative to the feeding direction A.

Subsequently, parts other than sewing margins 33 in the surface sheets 13, or general parts 34, are opened. The sewing margins 33 are kept overlaid on or close to each other, while being held perpendicular to the general parts 34 on the back side (the lower side as viewed in FIG. 9). In this case, the parts sewn by the upper thread 31 and the lower thread 32 and the sewing margins 33 cannot be seen or are barely seen from the front side.

Next, as shown in FIG. 8, the sewing margins 33 are opened and folded to the general parts 34 and overlaid onto the back side of the general parts 34. Then, a sewing cycle is performed using a sewing needle 22 (FIGS. 3A and 3B) having the same cross section CS as that in the above illustrated embodiment. Specifically, the sewing needle 22 is reciprocated with the diagonal line DL of the cross section CS being inclined relative to the feeding direction A (the line L2). In this case, closely arranged parallel stitch lines 17 are formed to approximate a straight line and have an improved appearance.

When the upholstery member 12 is formed only of a surface sheet 13, the upholstered article 10 is formed by directly bonding the surface sheet 13 onto the front face of the base member 11.

When bonding the upholstery member 12 to the base member 11, only one of the base member 11 and the upholstery member 12 may receive force that presses it to the other.

Not limited to vehicle interior parts, the above described stitch line forming method may be applied to any upholstered articles that have an upholstery member 12 in which a stitch line 17 is formed.

The invention claimed is:

1. A stitch line forming method comprising:

preparing an upholstery member and a sewing machine, wherein the sewing machine has a sewing needle having a quadrangular cross section in a plane parallel to a plane of the upholstery member, the quadrangular cross section of the sewing needle has two pairs of opposite corners, the quadrangular cross section of the sewing needle defines a pair of imaginary diagonal lines inside the quadrangular cross section between respective pairs of the two pairs of opposite corners of the quadrangular cross section, an upper thread, a lower thread, and a feeding direction in which the upholstery member is fed, wherein the upholstery member has a back face and a front face opposite to the back face;

forming the stitch line, by performing a sewing cycle, in which, while the upholstery member is fed in the feeding direction, the sewing needle is reciprocated in a thickness direction of the upholstery member, and the sewing needle is positioned with respect to the feeding direction so that at least one of the imaginary diagonal lines between respective pairs of the two pairs of opposite corners of the quadrangular cross section of the sewing needle is inclined relative to a line extending in the feeding direction, to form needle receiving holes in the upholstery member, wherein each one of the needle receiving holes has two pairs of opposing corners, and each one of the needle receiving holes has two diagonal lines between respective pairs of the two pairs of opposing corners, and the imaginary diagonal lines between respective pairs of the two pairs of opposite corners of the quadrangular cross section of the sewing needle correspond to the two diagonal lines between respective pairs of the two pairs of opposing corners of the needle receiving holes, at least one of the two diagonal lines of the needle receiving holes is inclined relative to the line extending in the feeding direction, wherein, for each one of the needle receiving holes, the upper thread passes from the front face of the upholstery member to the back face of the upholstery member, the upper thread crosses the lower thread located on the back face of the upholstery member, the upper thread passes back to the front face of the upholstery member through the each one of the needle receiving holes, and the upper thread extends to the front face of the upholstery member from one of the two pairs of opposing corners corresponding to the one of the two diagonal lines which is inclined relative to the line extending in the feeding direction, for the each one of the needle receiving holes; and applying a tension to the lower thread, the tensioned lower thread acts on the upper thread which extends from the one of the two pairs of opposing corners of the one of the two diagonal lines of each of the needle receiving holes, to reduce an inclination, relative to the feeding direction, of the one of the two diagonal lines of each of the needle receiving holes.

2. The stitch line forming method according to claim 1, wherein the sewing needle is reciprocated with the one of the imaginary diagonal lines between respective pairs of the two pairs opposite corners of the quadrangular cross section of the sewing needle being inclined by an angle in a range from 10° to 20° relative to the feeding direction in which the upholstery member is fed.

3. The stitch line forming method according to claim 1, wherein the upholstery member is formed only of the surface sheet.

4. The stitch line forming method according to claim 1, wherein the upholstery member includes the surface sheet and a cushion layer laminated on a back face of the surface sheet.

5. The stitch line forming method according to claim 1, wherein the quadrangular cross section of the sewing needle is at a distal end of the sewing needle where the quadrangular cross section passes through the upholstery member, and the quadrangular cross section is at an imaginary plane perpendicular to the axis of the distal end of the sewing needle.

6. The stitch line forming method according to claim 5, wherein the quadrangular cross section of the sewing needle that passes through the upholstery member has a diamond shape.

7. The stitch line forming method according to claim 1, wherein, during the forming of the stitch line, a plane of the quadrangular cross section of the sewing needle is parallel to a plane of the upholstery member.

8. The stitch line forming method according to claim 1, wherein the quadrangular cross section of the sewing needle has a diamond shape, and the opposite corners of one of the two pairs of opposite corners of the quadrangular cross section of the sewing needle have acute angles, wherein, for each one of the needle receiving holes, the opposing corners of the one of the two pairs of opposing corners have acute angles and are offset relative to the feeding direction, and the upper thread is located in the acute angles.

9. The stitch line forming method according to claim 1, wherein in the step of forming the stitch line, each of the imaginary diagonal lines between the respective pairs of the two pairs of opposite corners of the quadrangular cross section of the sewing needle is inclined relative to the feeding direction, and wherein, for each of the needle receiving holes formed in the upholstery member, each of the opposing corners of the two pairs of opposing corners is offset relative to the feeding direction.

10. The stitch line forming method according to claim 9, wherein the quadrangular cross section of the sewing needle that passes through the upholstery member has a diamond shape, and the opposite corners of one of the two pairs of opposite corners of the quadrangular cross section of the sewing needle have acute angles, wherein, for each of the needle receiving holes formed in the upholstery member, the opposing corners of the one of the two pairs of opposing corners from which the upper thread extends have acute angles, and the upper thread is located in the opposing corners of the one of the two pairs of opposing corners which have acute angles.

11. The stitch line forming method according to claim 1, wherein in the step of forming the stitch line, each of the needle receiving holes has four flat inner wall surfaces.

12. The stitch line forming method according to claim 1, wherein in the step of forming the stitch line, the at least one of the imaginary diagonal lines between the respective pairs of the two pairs of opposite corners of the quadrangular cross section of the sewing needle is inclined by an angle in a range from 10° to 20° relative to the line extending in the feeding direction, and for each of the needle receiving holes formed in the upholstery member, the opposing corners of at least one of the two pairs of opposing corners are offset relative to the feeding direction, and the upper thread extends from the opposing corners which are offset relative to the feeding direction.

13. The stitch line forming method according to claim 8, wherein in the step of forming the stitch line, the at least one of the imaginary diagonal lines between the respective pairs of the two pairs of opposite corners of the quadrangular cross section of the sewing needle is inclined by an angle in a range from 10° to 20° relative to the line extending in the feeding direction, and for each of the needle receiving holes formed in the upholstery member, the opposing corners of at least one of the two pairs of opposing corners are offset relative to the feeding direction, and the upper thread extends from the opposing corners which are offset relative to the feeding direction.

* * * * *